US005148135A

United States Patent [19]

Stein

[11] Patent Number: 5,148,135

[45] Date of Patent: Sep. 15, 1992

[54] ELECTRONIC HARDWARE PACKAGE

[75] Inventor: Adolph J. Stein, Santa Barbara, Calif.

[73] Assignee: Raytheon Company, Lexington, Mass.

[21] Appl. No.: 754,865

[22] Filed: Sep. 4, 1991

[51] Int. Cl.[5] ..... H01P 5/00

[52] U.S. Cl. ..... 333/246; 174/260; 333/260; 439/65

[58] Field of Search ..... 333/246, 247, 260; 361/398, 403, 413; 174/250, 251, 260; 439/49, 65, 66, 86, 90, 91

[56] References Cited

U.S. PATENT DOCUMENTS

| | | | |
|---|---|---|---|
| 3,218,584 | 11/1965 | Ayer | 333/246 |
| 3,270,311 | 8/1966 | Deer et al. | 439/65 |
| 4,143,342 | 3/1979 | Cain et al. | 333/246 X |
| 4,208,642 | 6/1980 | Saunders | 333/246 |
| 4,295,700 | 10/1981 | Sado | 439/65 X |
| 5,021,866 | 6/1991 | Sudo et al. | 333/247 X |

FOREIGN PATENT DOCUMENTS

| | | | |
|---|---|---|---|
| 92102 | 6/1983 | Japan | 333/247 |

*Primary Examiner*—Paul Gensler

*Attorney, Agent, or Firm*—Judith A. Caplan; Richard M. Sharkansky

[57] ABSTRACT

A connector for RF packages which provides both RF and DC signals to the package. The connector comprises a silicone block with an embedded RF jumper which connects an RF conductor on the package to an RF feed line. The block also has numerous conductive strips passing through it. These conductive strips connect DC feed lines to DC input pads on the package. The connector is compressed by means of a cover, deforming the elastomer block. The block serves to envornmentally seal the RF and DC inputs from the environmental effects.

20 Claims, 2 Drawing Sheets

ELECTRONIC HARDWARE PACKAGE

BACKGROUND OF THE INVENTION

This invention relates generally to packaging for electronic hardware and more particularly to packaging of microwave components.

As is known in the art, to maintain proper operation, microwave circuits must be protected from environmental conditions such as moisture. Accordingly, such circuits are often environmentally sealed in packages. One such package is described in U.S. Pat. No. 4,724,409 issued Feb. 9, 1988, to George R. Lehman, entitled "Microwave Circuit Package Connector", and assigned to the assignee of the present invention. That package includes a radio frequency (RF) conductor, or trace which carries RF signals to or from microwave circuits disposed within the package. Also, the package includes direct current (DC) conductors, or signal lines which carry power to the microwave circuit elements inside the package.

As is also known in the art, the conductors connecting circuit elements inside a microwave package to external components are not generally environmentally sealed. Therefore, such connections can be easily harmed by environmental factors such as moisture.

One way known in the art to counter this problem is to encapsulate the entire microwave system in a sealed container. However, this method of protecting the connections creates many problems. For example, it is more costly to produce. It also makes assembly and repair of the system more difficult.

It would therefore be desirable to have a simple environmentally sealed connector for carrying both RF and DC signals to a sealed microwave circuit package. Such a connector, though, must remain moisture sealed even if there is thermal expansion or contraction of the package or the connector.

SUMMARY OF THE INVENTION

With the foregoing background in mind, it is an object of this invention to provide an environmentally sealed interconnect for electronic hardware packages.

It is also an object of this invention to provide such package with an interconnect that can be easily assembled.

It is a further object to provide such package with an interconnect for both DC and RF signals.

It is yet another object to provide an environmentally sealed interconnect which withstands thermal expansion.

The foregoing and other objects are achieved with apparatus comprising a base having a surface with a first RF signal trace disposed thereon. An RF package, having a surface with a second RF signal trace disposed thereon, is disposed over the base such that the first RF signal trace is disposed adjacent to the second RF signal trace. The apparatus further comprises a block of elastic material having a metal conductor partially embedded therein, wherein the metal conductor is disposed in contact with the first RF signal trace and with the second RF signal trace.

With this arrangement, a connector is provided for connecting RF signal traces and environmentally sealing such interconnection. The partially embedded metal conductor of the elastic block connects an RF signal trace on the base to the RF signal trace on the RF package. The elastic block is pressed tightly in place by a cover to form a moisture seal around the RF signal traces.

In accordance with a further aspect of the present invention, the RF package includes at least one DC pad and the apparatus additionally comprises a strip having at least one exposed conducting portion, wherein the conducting portion is in contact with the block of elastic material. The elastic block covers the at least one DC pad and includes a plurality of strips of conductive material with a portion of the conductive strips electrically connected to the DC pad and the exposed conducting portion.

With this arrangement, DC connections are made to microwave circuits disposed within the RF package. More particularly, the strip having at least one conducting portion is coupled to the at least one DC pad of the RF package by the conductive strips of the elastic block. In assembly, when the elastic block is pressed tightly in place, environmental protection is provided to such DC connections.

BRIEF DESCRIPTION OF THE DRAWINGS

The invention will be better understood by reference to the following more detailed description and accompanying drawings in which.

DESCRIPTION OF THE PREFERRED EMBODIMENTS

Figure 1:
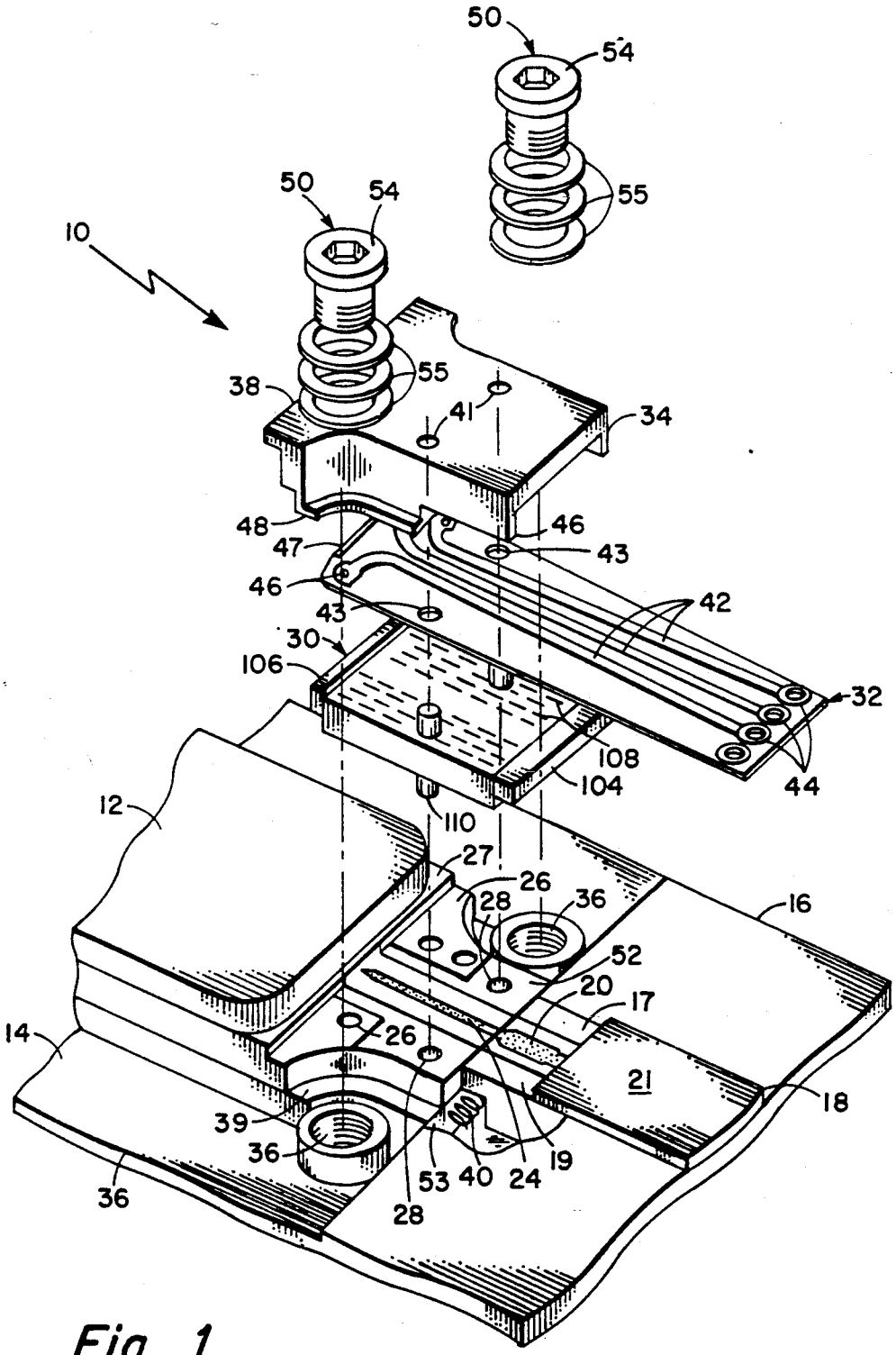
FIG. 1 is an exploded view of a portion of a microwave system incorporating the connector of the invention.

Referring now to FIG. 1, an exploded view of an integrated RF and DC connector 10 may be seen. Connector 10 couples both RF and DC signals to or from a package 12. Package 12 is hermetically sealed and contains microwave circuit elements (not shown).

Package 12 rests on some appropriate base such as a cold plate 14. Cold plate 14 may be made of any suitable material such as aluminum. Package 12 butts against a base 16, here made of aluminum. Base 16 and cold plate 14 are portions of any microwave system. For example, they could be portions of a transmitter.

Base 16 has dielectric slab 17 disposed in a groove (not numbered) therein. An example of a suitable material for dielectric slab 17 is sold under the trade name Duroid by Rogers, Inc., of Chandler, Ariz. Dielectric slab 17 has an RF signal trace 20 formed thereon by conventional techniques and conductive surface portions 19. Here, signal trace 20 is a microstrip transmission line.

Dielectric slab 17 has a portion thereof covered by an upper plate 18. Upper plate 18 is comprised of a dielectric, such as that comprising dielectric slab 17, and has conductive upper surface 21. Upper plate 18 is attached, such as by bonding or with screws, to base 16. The conductive upper surface 21 of upper plate 18, in conjunction with conductive surface portions 19 of dielectric slab 17 and conductive upper surface portions 52 of package 12, form a ground plane.

Package 12 is positioned so that an RF signal trace 24 disposed thereon is adjacent to RF signal trace 20. RF trace 24 carries RF signals into package 12, and here, is a strip line transmission conductor. There is a discontinuity between RF traces 20 and 24. This discontinuity is bridged by a conductor 112 (FIG. 2) in a manner described in greater detail below. Suffice it here to say that RF signals can be provided to electronic components (not shown) inside package 12 by RF traces 20 and 24.

Package 12 also has a plurality of DC pads 26. DC pads 26 connect to conductive traces (not shown) which run through the walls of package 12 to provide DC power connections to the microwave circuit components (not shown) disposed in package 12. An example of such a package 12 is described in the above-mentioned U.S. Pat. No. 4,724,409.

When connector 10 is assembled, DC power is supplied to DC pads 26 via DC traces 42 of a flexible cable 32. As is known, DC traces 42 are embedded within flexible cable 32. Connections to DC traces 42 are made by bringing a portion of the DC traces 42 to surface of flexible cable 32. Here, DC traces 42 are brought to the upper surface of flexible cable 32 at a plurality of DC inputs 44. In operation, DC power supplies (not shown) are connected to DC inputs 44.

The opposite ends 46 of DC traces 42 are brought to the lower surface (not shown) of flexible cable 32. It should be noted that when connector 10 is assembled, ends 46 of DC traces 42 are disposed approximately in vertical alignment with DC pads 26.

Flexible cable 32 is, however, separated from DC pads 26 by an elastomer block 30. Elastomer block 30 is described in greater detail in conjunction with FIG. 2. Suffice it here to say that the positioning of ends 46 of DC traces 42 above DC pads 26 is ensured by alignment pins or posts 110 of elastomer block 30. More particularly, alignment pins 110 pass through alignment holes 43 disposed through flexible cable 32, alignment holes 41 disposed through a cover 38, and alignment holes 28 disposed through an upper portion of package 12. Preferably, alignment pins 110 extend through alignment holes 41 of cover 38 such that the upper ends of pins 110 are flush with the upper surface of cover 38. Further note that elastomer block 30 contains numerous gold strips 108 (FIG. 2) running from the top to the bottom of the elastomer block 30. These gold strips 108 provide a conductive path from DC traces 42 to DC pads 26, or more particularly, from ends 46 of DC traces 42 to DC pads 26. Thus, DC power supplied at DC inputs 44 is coupled to microwave circuit elements (not shown) inside package 12.

Elastomer block 30 and flexible cable 32 are disposed under cover 38. Cover 38 has contact flanges 48 which are disposed over complementary flange portions 39 of package 12 when connector 10 is assembled. Cover 38 is held in place by screw assemblies 50. Screw assemblies 50 include screws 54 which are inserted in screw holes 36, such screw holes 36 being disposed on cold plate 14, as shown. Screws 54 contact flanges 48 of cover 38, thereby securing cover 38 and package 12 firmly to cold plate 14. Here, assemblies 50 further include three spring washers 55 which compensate for tolerances and thermal expansion.

Note that additional packages (not shown), like package 12, may be disposed over cold plate 14, adjacent to package 12. More particularly, such additional packages would butt against package 12 such that flange portions thereof, in conjunction with flange portions 39 of package 12 would surround screw holes 36. However, if only one package 12 is disposed on cold plate 14, as shown, it may be desirable to provide a boss (not shown) coupled to cold plate 14 to surround screw hole 36 such that screws 54 contact a level surface formed by cover flanges 48 and such a boss.

In addition to securing cover 38 and package 12 to cold plate 14, tightening screw assemblies 50 also compresses elastomer block 30 against RF traces 20 and 24 and DC pads 26. In this way, RF traces 20 and 24 and DC pads 26 are sealed from environmental factors.

To ensure a tight environmental seal, the surface portions 19 of dielectric slab 17 should be flush with surface portions 52 of package 12. To ensure proper alignment of surface portions 19 and 52, dielectric slab 17 rests on a ground spring 40. More particularly, ground spring 40 is disposed under dielectric slab 17 and within base 16, as shown in the cutaway portion of FIG. 1. When screw assemblies 50 are tightened, ground spring 40 is compressed to align surface portions 19 of dielectric slab 17 with surface portions 52 of package 12. Also, in accordance with conventional microwave circuit manufacturing techniques, the lower surface of dielectric slab 17 is a conductive ground plane. Such ground plane is electrically connected to other ground planes in the system, in order to provide effective EMI shielding. More particularly, ground spring 40 is made of a conductive material and connects the ground plane disposed on the lower surface of dielectric slab 17 to base 16 and to a side surface 53 of package 12, such base 16 and side surface 53 thereby forming part of the ground plane.

Elastomer block 30 contains conductive regions 104 and 106 disposed at opposite ends thereof. These regions 104 and 106 provide an RF ground plane arrangement and improve the performance of RF microstrip transmission line or signal trace 20 by forming a channel comprised of ground plane surfaces bordering such trace 20. More particularly, conductive region 104 couples conductive surface 21 of upper plate 18 to a conductive portion on the lower surface of flexible cable 32. Conductive region 106 couples package 12 to flexible cable 32. Specifically, conductive region 106 rests on a ledge 27 of package 12 such that when cover 38 is in place, a conductive tab 47 of flexible cable 32 contacts conductive region 106 and cover 38.

Figure 2:
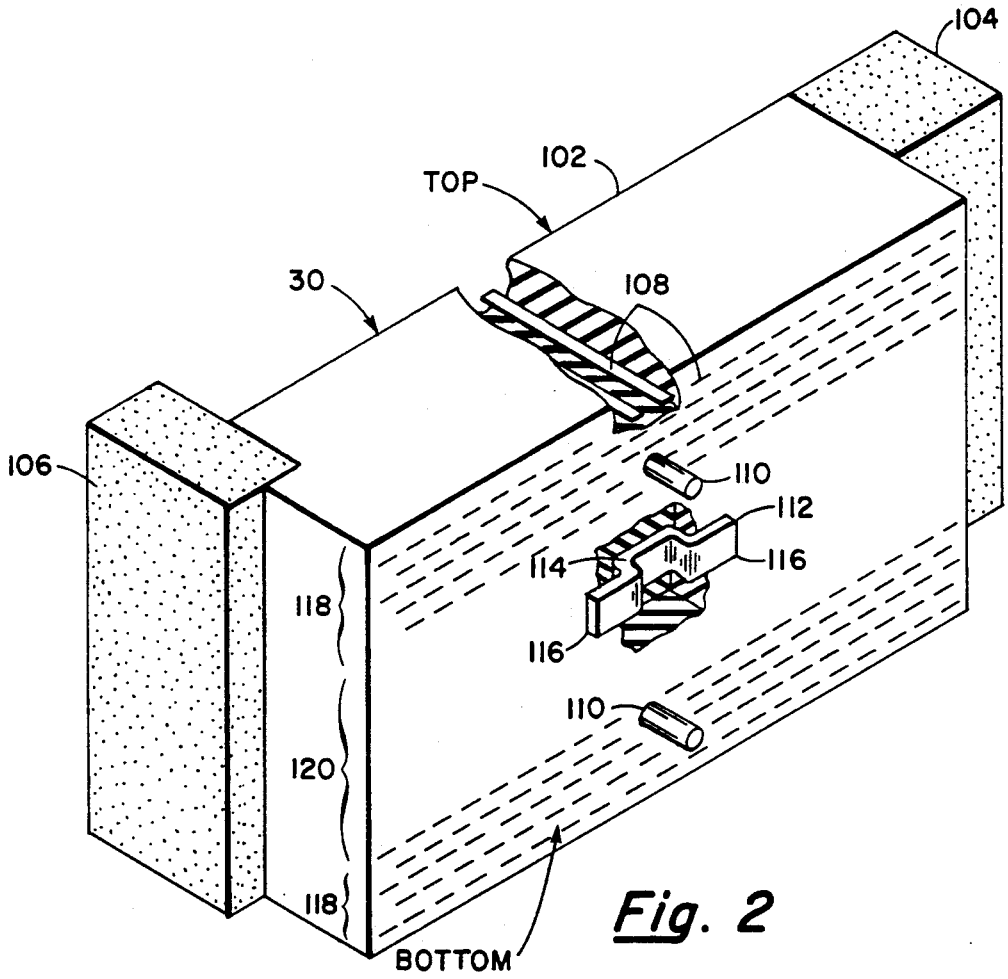
FIG. 2 is an isometric view of the elastomer block of the connector in FIG. 1.

Turning now to FIG. 2, additional details of elastomer block 30 may be seen. Elastomer block 30 has a central region 102. Central region 102 includes first and second DC connecting portions 118, each of such identical portions 118 having a plurality of gold strips 108 embedded therein running from a top surface to a bottom surface of elastomer block 30, as shown. As described above, gold strips 108 connect DC traces 42 of flexible cable 32 (FIG. 1) to DC pads 26 of package 12 (FIG. 1). Here, each gold strip 108 has a thickness of approximately 0.0005 inches and is spaced from adjacent gold strips 108 by approximately 0.005 inches.

First and second DC connecting portions 118 of central region 102, having gold strips 108 embedded therein, may be commercially purchased. For example, elastomeric connectors sold under the trade name MATRIX MOE connectors by Elastomeric Technologies, Inc., of Hatboro, Pa., might be used.

Central region 102 further includes an RF connecting portion 120 disposed between first and second DC connecting portions 118. RF connecting portion 120 is comprised of a silicone elastomer with a dielectric constant of 2.9 or less. An example of a suitable material for elastomer block portion 120 is sold under the trade name X3-6121 sold by Dow Chemical Company. Here, elastomer block 30 is formed by using conventional molding techniques to form RF connecting portion 120 between first and second DC connecting portions 118.

Elastomer portion 120 has, partially embedded therein a conductor 112. More particularly, conductor 112 has an embedded section 114 and exposed flat sections 116. Section 114 is embedded in elastomer portion 120 by molding tooling, thus securing conductor 112 in place. Exposed flat segments 116 are disposed parallel to the bottom surface of elastomer portion 120.

Here, conductor 112 is comprised of gold approximately 0.002 inches thick by 0.01 inches wide. Embedded segment 114 is approximately 0.015 inches long and is embedded in central region 102 to a depth of between approximately 0.005 and 0.010 inches. Here, flat segments 116 each have a length of approximately 0.01 inches and are spaced from the bottom surface of central region 102 by approximately 0.005 inches.

Central region 102 has two alignment pins or posts 110 extending therethrough. Alignment pins 110 fit into corresponding alignment holes 28 disposed in package 12 and through alignment holes 43 of flexible cable 32 and alignment holes 41 of cover 38, as described above in conjunction with FIG. 1. With elastomer block 30 thus positioned, each flat segment 116 will contact one of the RF signal traces 20 and 24 (FIG. 1). In this way, conductor 112 connects RF traces 20 and 24 (FIG. 1).

As mentioned above, elastomer block 30 contains conductive regions 104 and 106. Each of such regions 104 and 106 is comprised of silver impregnated silicone elastomer. The silver filaments of regions 104 and 106 render such regions conductive. An example of a suitable silver impregnated material for conductive regions 104 and 106 is sold under the trade name Comerics material by Comerics of Woburn, Mass. Silver impregnated regions 104 and 106 are attached here by bonding, to central region 102. Referring back to FIG. 1, it can be seen that silver impregnated region 104 electrically connects flexible cable 32 to conductive surface 21 of upper plate 18, helping to ensure that both are at the same potential, here ground. Silver impregnated region 106 electrically connects cover 38 and conductive tab 47 of flexible cable 32 to package 12 via package ledge 27 (FIG. 1). In this way, impregnated regions 104 and 106 provide EMI shielding and improve the performance of RF microstrip signal trace 24, as described above.

It can be seen then that when connector 10 is assembled, electrical connections for RF signals, ground, and DC power will be provided. Moreover, cover 38 will tightly compress elastomer block 30 against all exposed conductors, such as RF traces 20 and 24 and DC pads 26. The conductors will thus be sealed against environmental factors. Due to the flexibility of elastomer block 30, a tight seal is provided by elastomer block 30 even if thermal expansion causes slight movement of package 12 relative to base 16.

Having described one embodiment of the invention, it will be apparent that various alterations could be made. Elastomer block 30 might be any deformable dielectric. Any number of DC pads 26 and RF embedded conductors 112 might be employed. Also, the disclosed connector might be used to couple signals into other types of packages than the specific package shown here. It is felt, therefore, that the invention should be limited only by the spirit and scope of the appended claims.

What is claimed is:

1. Apparatus comprising:

a) a base having a surface with a first RF signal trace disposed on the surface;

b) an RF package disposed on the base, said package having a surface with a second RF signal trace disposed on the surface, the first RF signal trace being disposed adjacent the second RF signal trace; and c) means, including a block of elastic material disposed over said first and second RF signal traces having a metal conductor partially embedded in the elastic material, said metal conductor being disposed in contact with the first RF signal trace and with the second RF signal trace, for electrically connecting the first and second RF signal traces.

2. The apparatus of claim 1 additionally comprising means for compressing the block of elastic material against the surface of the RF package and against the surface of the base.

3. The apparatus of claim 2 wherein corresponding the block of elastic material causes a deformation of the elastic material.

4. The apparatus of claim 2 wherein the compressing means comprises a cover coupled to the base.

5. The apparatus of claim 1 wherein the block of elastic material comprises silicone.

6. The apparatus of claim 1 wherein the surface of the base comprises a dielectric slab.

7. Apparatus comprising:

a) a base having a surface with a first RF signal trace disposed on the surface;

b) an RF package disposed on the base, said package having a surface with a second RF signal trace disposed on the surface, the first RF signal trace being disposed adjacent the second RF signal trace; and c) means, including a block of elastic material having a metal conductor partially embedded in the elastic material, said metal conductor being disposed in contact with the first RF signal trace and with the second RF signal trace, for electrically connecting the first and second RF signal traces;

said block of elastic material comprising silicone, said block of silicone comprising a first silver impregnated region disposed in electrical contact with the RF package.

8. The apparatus of claim 7 wherein the block of silicone comprises a second silver impregnated region in electrical contact with the base.

9. Apparatus comprising:

a) a base having a surface with a first RF signal trace disposed on the surface;

b) an RF package disposed on the base, said package having a surface with a second RF signal trace disposed on the surface, the first RF signal trace being disposed adjacent the second RF signal trace; and c) means, including a block of elastic material having a metal conductor partially embedded in the elastic material, said metal conductor being disposed in contact with the first RF signal trace and wit the second RF signal trace, for electrically connecting the first and second RF signal traces, wherein the surface of the base comprises a dielectric slab; and d) a spring, said spring being disposed between the dielectric slab and a second surface of the base.

10. Apparatus comprising:

a) a base having a surface with a first RF signal trace disposed on the surface;

b) an RF package disposed on the base, said package having a surface with a second RF signal trace disposed on the surface, the first RF signal trace being disposed adjacent the second RF signal trace;

c) means, including a block of elastic material having a metal conductor partially embedded in the elastic material, said metal conductor being disposed in contact with the first RF signal trace and wit the second RF signal trace, for electrically connecting the first and second RF signal traces;

d) at least one DC pad;

e) a strip having at least one exposed conducting portion, said conducting portion being in contact with the block of elastic material; and f) wherein the elastic block covers the at least one DC pad, and includes a plurality of strips of conductive material with a portion of the conductive strips being electrically connected to the DC pad and the exposed conducting portion.

11. The apparatus of claim 10 wherein the strip comprises a flexible cable.

12. A system of the type having a source of DC power and a source of RF signals incorporating the apparatus of claim 10 wherein the conducting portion is connected to the source of DC power and the RF signal trace on the base is connected to the RF signal source.

13. In combination:

a) an RF package having a conductive region on a first surface;

b) a block having a plurality of conductive members running therethrough, said block being disposed on the first surface of the RF package with a portion of the conductive members in contact with the conductive region; and c) a flexible cable having a bottom side in contact with the block, said flexible cable having a conductive section on its bottom side, said conductive section being disposed above the conductive region of the RF package.

14. The combination of claim 13 wherein the block comprises an elastic material.

15. The combination of claim 14 additionally comprising means for compressing the flexible cable against the block and for compressing the block against the first surface of the RF package.

16. The combination of claim 15 wherein the compressing means comprises a cover.

17. The combination of claim 16 wherein:

a) the cover, the flexible cable, and the RF package each have at least one hole disposed therethrough; and b) the block has at least one post mounted thereto, said at least one post disposed through the holes in the cover, the flexible cable, and the RF package.

18. An RF system of the type having RF components sealed inside a package with an RF conductor and a DC conductor outside the package coupled to the RF components, said system adapted for coupling a source of RF signals and a source of DC power to said components, said system comprising:

(a) means, comprising a mechanically compressible block having embedded conductive material, for coupling an RF signal from the RF signal source to the RF conductor and for coupling a DC signal from the DC power source to the DC conductor; and (b) means for compressing the block to seal the RF conductor and DC conductor from the environment.

19. The RF system of claim 18 wherein the block comprises a block of silicone elastomer having a conductor embedded in one surface and a plurality of conductors passing through the silicone.

20. The RF system of claim 19 wherein the means for compressing comprises a cover.

* * * * *